US010436543B2

(12) United States Patent
Wilkens

(10) Patent No.: US 10,436,543 B2
(45) Date of Patent: Oct. 8, 2019

(54) ARCHERY STABILIZER

(71) Applicant: Jeremy Wilkens, Huntington Beach, CA (US)

(72) Inventor: Jeremy Wilkens, Huntington Beach, CA (US)

( * ) Notice: Subject to any disclaimer, the term of this patent is extended or adjusted under 35 U.S.C. 154(b) by 0 days.

(21) Appl. No.: 16/238,194

(22) Filed: Jan. 2, 2019

(65) Prior Publication Data

US 2019/0212092 A1 Jul. 11, 2019

(30) Foreign Application Priority Data

Jan. 5, 2018 (CA) ..... 2990930

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
See application file for complete search history.

(56) References Cited

U.S. PATENT DOCUMENTS 5,339,793 A * 8/1994 Findley ..... F41B 5/1426 124/89
5,370,104 A * 12/1994 Neie ..... F41B 5/1426 124/89
5,411,009 A * 5/1995 Thompson ..... F41B 5/1426 124/88
5,617,664 A * 4/1997 Troncoso ..... F41A 3/80 124/89
5,735,257 A * 4/1998 Walk ..... F41B 5/1426 124/89
5,996,570 A * 12/1999 Legate ..... F41B 5/1426 124/89
6,186,135 B1 * 2/2001 Harwath ..... F41B 5/1426 124/89

(Continued)

OTHER PUBLICATIONS https://www.shrewdarchery.com/, Shrewd Archery, 5 pages.

(Continued)

*Primary Examiner* — John A Ricci
(74) *Attorney, Agent, or Firm* — Davis & Bujold PLLC; Michael J. Bujold

(57) ABSTRACT

An archery stabilizer includes a tubular member and an insert member. The tubular member has a first end, a second end and an interior sidewall defining an interior bore that extends between the first end and the second end. The tubular member has a first resonance frequency. The insert member is positioned in the interior bore and extends for more than one third of the length of the tubular member. The insert member has an exterior surface. The insert member has a second resonance frequency that differs from the first resonance frequency. A vibration dampening gel is positioned between the exterior surface of the insert member and the interior sidewall of the tubular member. A mounting assembly is positioned at the first end of the tubular member, whereby the archery stabilizer is mounted to an archery bow. A weight support assembly is positioned at the second end of the tubular member, whereby one or more weights are supported.

9 Claims, 3 Drawing Sheets

(56) References Cited

U.S. PATENT DOCUMENTS

| | | | | |
|---|---|---|---|---|
| 6,283,109 | B1 * | 9/2001 | Wiseby | F41B 5/1426 124/89 |
| 6,494,196 | B2 * | 12/2002 | Harwath | F41B 5/1426 124/89 |
| 6,681,755 | B2 * | 1/2004 | Pujos | F41B 5/1426 124/89 |
| 7,213,590 | B2 * | 5/2007 | Pellerite | F41B 5/1426 124/89 |

OTHER PUBLICATIONS http://www.doinker.com/catalog, Doinker (8166963), 4 pages.
https://www.beestinger.com/Home.aspx, Dead Center Archery Products, 5 pages.
http://www.deadcenterarchery.com/iconx-625-series/, Stokerized stabilizers, 1 page.
http://dragonflightarchery.com/?page_id=1441, Jeremy Wilkens, 2 pages.

* cited by examiner

ARCHERY STABILIZER

FIELD

There is described a stabilizer that is used to stabilize an archery bow.

BACKGROUND

Archery stabilizers mount to the back of a bow riser by screwing into a standardized threaded hole that come standard on almost all bows sold today. The stabilizer adds weight out in front of the archer to help steady the bow during the draw cycle of the arrow and hold steady while at full draw. This results in better aiming of the arrow.

Once the arrow is in flight, a tremendous amount of energy is released, causing the bow to torque and twist in the archer's hand. The stabilizer helps resist this torque similar to the way a tightrope walker will use a long pole with weighted ends. The longer the pole and the heavier the end weights, the more control the tightrope walker will have over torque. The same is true of archery stabilizers.

Another benefit can be to reduce felt vibration during the shot. When the arrow is released the force will travel through the bow limbs, riser and into the archers hand. A stabilizer will allow the vibration forces to travel away from the archer's hand, and down the length of the stabilizer.

All Stabilizers on the market operate with a similar principle; keep the added weights as far from the archer as possible, therefore creating the most stability at a given length. More mass weight at the distal end of the stabilizer typically means a steadier shot. The problem this creates is that by adding more weight further away from the bow attachment, the more rigid the stabilizer tube must become. The stiffer the rod the higher the rod vibration, also called resonance vibration. What this means to the archer is that the energy that was transmitted through the bow and away from the archer through the stabilizer ends up coming back to the archers hand through the same path through the stabilizer. What is required is an archery stabilizer which is less prone to resonance vibration.

The problem of resonance vibration is currently tackled by two methods. The first method is to add a rubber material around the outside of the stabilizer tube (like a donut) or inside the tube (like a plug) to absorb some vibration in a contact area where the rubber and tube intersect. The second way is to change the profile of the stabilizer rod to have a non-constant cross section, through a tapered profile or variable wall thickness.

SUMMARY

There is provided an archery stabilizer which includes a tubular member and an insert member. The tubular member has a first end, a second end and an interior sidewall defining an interior bore that extends between the first end and the second end. The tubular member has a first resonance frequency. The insert member is positioned in the interior bore and extends for more than one third of the length of the tubular member. The insert member has an exterior surface. The insert member has a second resonance frequency that differs from the first resonance frequency. A vibration dampening gel is positioned between the exterior surface of the insert member and the interior sidewall of the tubular member. A mounting assembly is positioned at the first end of the tubular member, whereby the archery stabilizer is mounted to an archery bow. A weight support assembly is positioned at the second end of the tubular member, whereby one or more weights are supported.

The archery stabilizer, as described above, reduce resonance vibration by creating two paths for the vibration to travel that are isolated by vibration dampening gel. As stated above, the tubular member vibrates at a first resonance frequency. However, the insert member vibrates at a second resonance frequency, that differs from the first resonance frequency, due to its different diameter and wall thickness. Vibration dampening gel absorbs vibration in both directions, when the shock is traveling from the bow to the weight assembly, as well as when the shock is traveling back from the weight support assembly to mounting assembly.

Although beneficial results may be obtained when vibration dampening gel is distinct component in the form of a sleeve, more beneficial results may be obtained when the vibration dampening gel encapsulates the insert member and is bonded to the interior sidewall of the tubular member.

Although beneficial results may be obtained through the use of the archery stabilizer, as described above, supporting the tubular member on both the interior and exterior diameters proved to further reduced vibration during the development process. Early tests showed that support of the tubular member on the exterior as well as interior diameters greatly improved tube vibration over either option independently. This was yet again improved when the insert member and the tubular member were mechanically fastened together through a mechanical connection, such as a threaded connection.

Although beneficial results may be obtained when the insert member is a solid rod, it is preferred that measures be taken to avoid unduly increasing the weight of the archery stabilizer. Even more beneficial results may, therefore, be obtained when the insert member is tubular having a first end and a second end, the first end being secured to the mounting assembly and the second end being closed by a closure.

At first the type of closure was not viewed as being of importance. However, a plug does not function as well as an end cap. It is now preferred that a bullet-shaped end cap be used. The bullet-shaped end cap allows the insert member to contact the internal diameter of the tubular member, while still allowing the gel material to be poured in place and make full contact to both the exterior surface of the insert member as well as the interior sidewall of the tubular member. The bullet-shaped end cap becomes encapsulated and embedded in the vibration dampening gel. This contact point, via the bullet-shaped end cap embedded in vibration dampening gel, results in reduced flexibility of the second end of the archery stabilizer. The added support of the insert member changes the amount of flex in the archery stabilizer through the double supported zone. The result is a less flex, without changing the wall thickness or shape of the tubular member and without increasing the resonant vibration.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
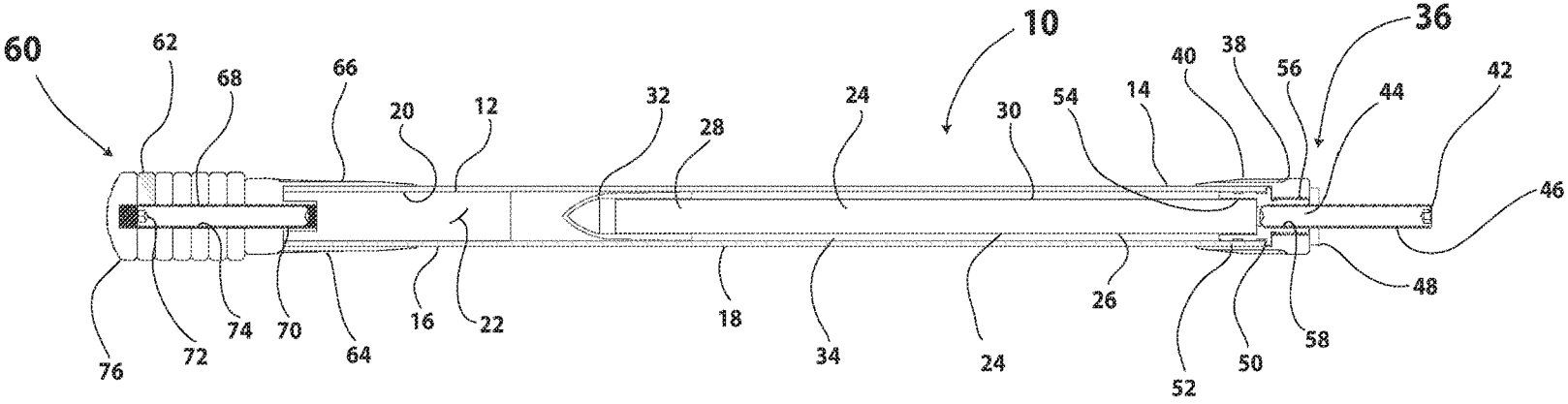
FIG. 1 is side elevation view, in section, of an archery stabilizer.

An archery stabilizer generally identified by reference numeral 10, will now be described with reference to FIG. 1 through FIG. 3.

Figure 2:
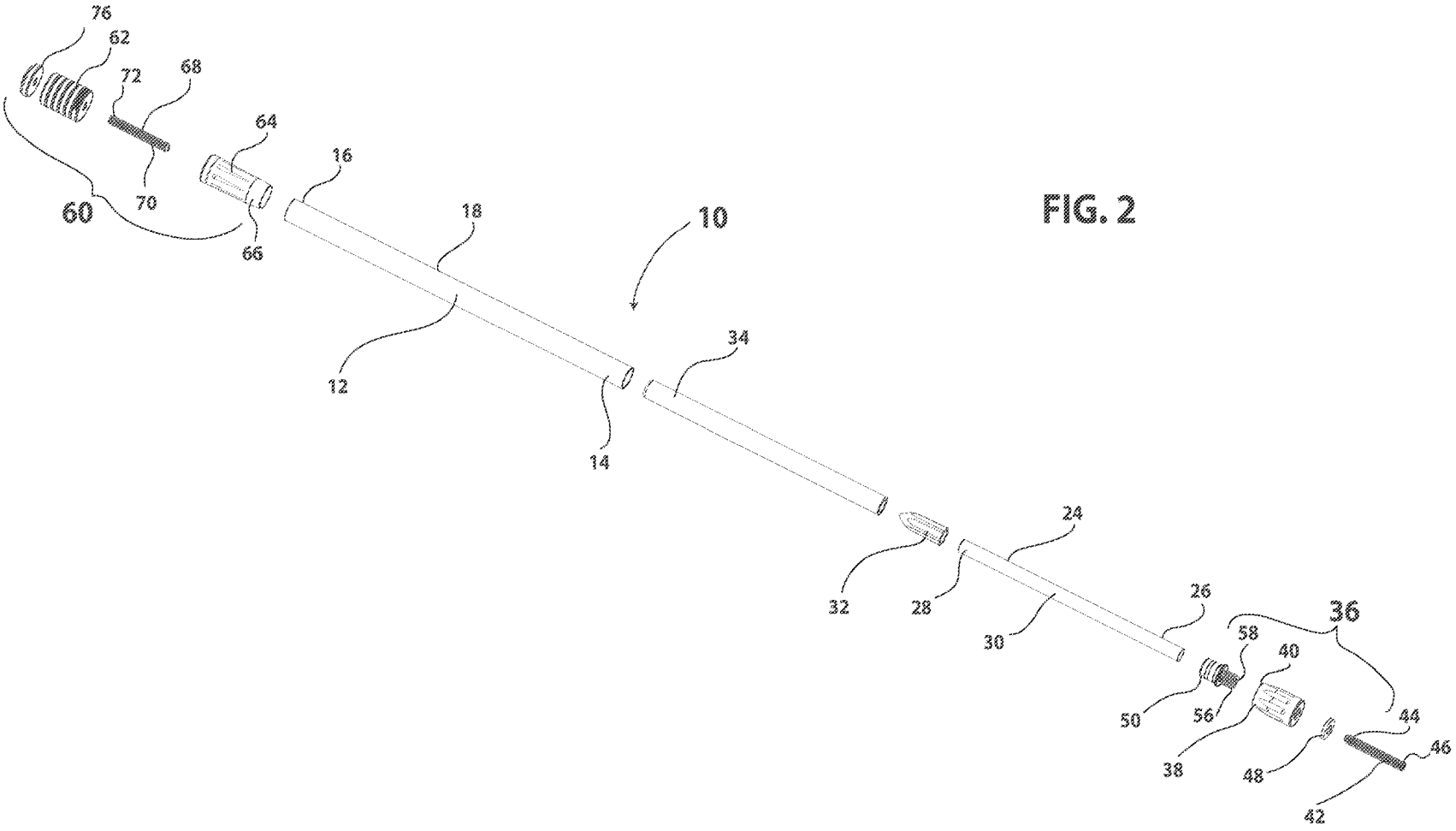
FIG. 2 is an exploded perspective view of components of the archery stabilizer of FIG. 1.

Structure and Relationship of Parts:

Referring to FIG. 1, archery stabilizer 10 is illustrated. Referring to FIG. 2, the components of archery stabilizer 10 are shown in an exploded view. A tubular member 12 is provided having a first end 14, a second end 16, and an exterior surface 18. Referring to FIG. 1, features of tubular member 12 not visible in FIG. 1 are an interior sidewall 20 which serves to define an interior bore 22. Interior bore 22 extends between first end 14 and second end 16.

Tubular member 12 has a first resonance frequency.

Referring to FIG. 1, an insert member 24 is positioned in interior bore 22, extending from first end 14 for more than one third of the length of tubular member 12. It will be noted that insert member 24 is also tubular. Referring to FIG. 2, insert member 24 has a first end 26, a second end 28, and an exterior surface 30. Second end 28 is closed by a closure in the form of a bullet shaped cap 32. Insert member 24 has a second resonance frequency that differs from the first resonance frequency of tubular member 12.

Referring to FIG. 1, vibration dampening gel 34 is positioned between exterior surface 30 of insert member 24 and interior sidewall 20 of tubular member 12. It is preferred that vibration dampening gel 34 encapsulate insert member 24 (including bullet-shaped cap 32) and also be bonded to interior sidewall 20 of tubular member 12.

Figure 3:
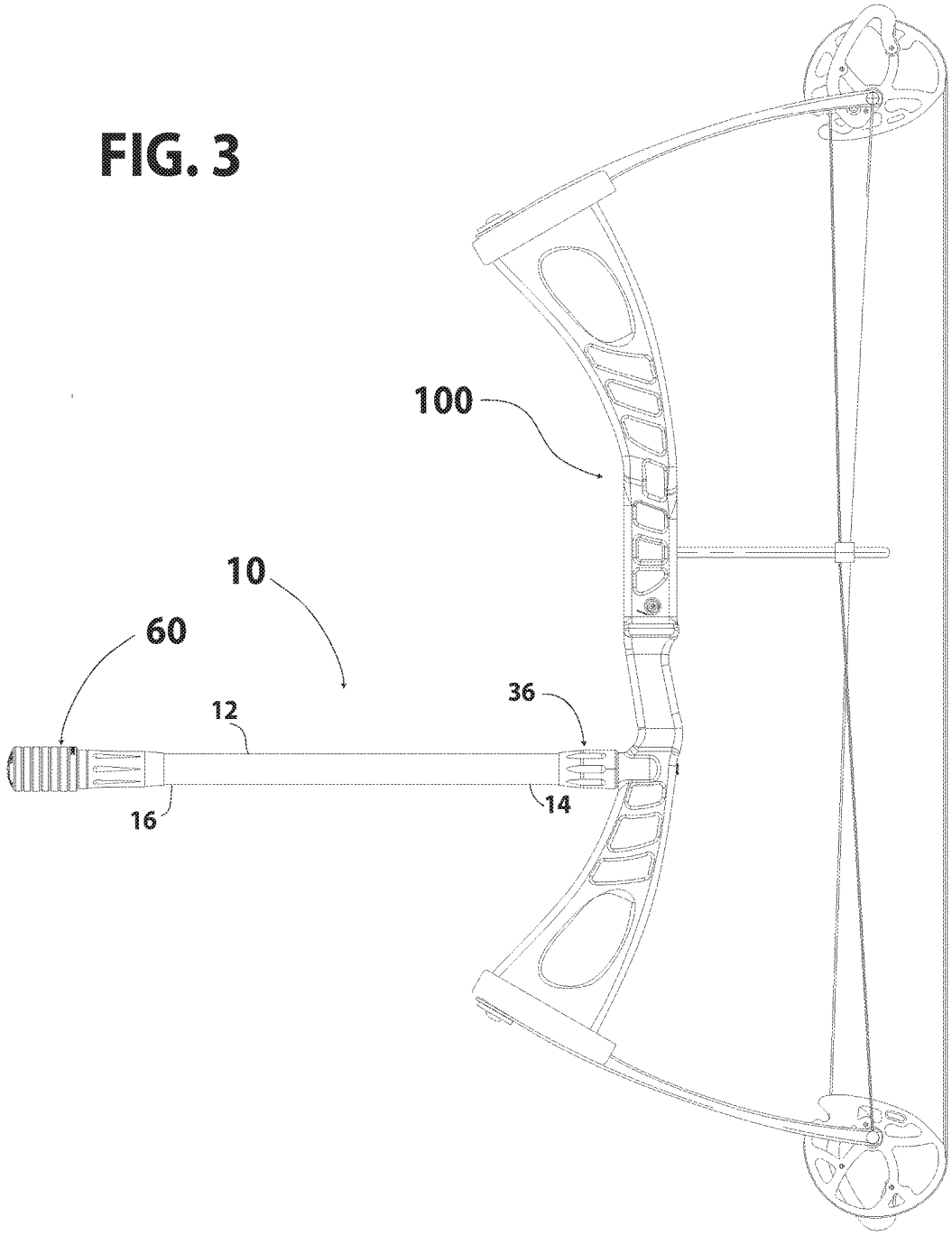
FIG. 3 is a side elevation of the archery stabilizer of FIG. 1 mounted on an archery bow.

Referring to FIG. 1, a mounting assembly, generally indicated by reference numeral 36, is provided at first end 14 of tubular member 12, whereby archery stabilizer 10 is mounted to an archery bow 100, as shown in FIG. 3. Referring to FIG. 2, mounting assembly 36 includes a body 38 having a collar 40. Referring to FIG. 1, collar 40 overlies exterior surface 18 at first end 14 of tubular member 12. Referring to FIG. 2, a cantilevered bow mounting screw 42 is provided having a first end 44 supported by body 38 and a remote end 46. A lock washer 48 is provided to maintain first end 44 of mounting screw 42 engaged with body 38. An annular mounting plug 50 is provided. Referring to FIG. 1, annular mounting plug 50 has an exterior surface 52 that engages interior sidewall 20 of tubular member 12 and an interior surface 54 that engages exterior surface 30 of insert member 24. Referring to FIG. 2, annular mounting plug 50 is coupled with body 38 by mating threaded connection 56. It is preferred that first end 44 of mounting screw 42 engage a bore 58 in annular mounting plug 50, as through a series of threaded connections insert member 24, tubular member 12 and mounting screw 42, which engages archery bow 100 as shown in FIG. 3, become mechanically fastened together.

Referring to FIG. 1, a weight support assembly, generally identified by reference numeral 60, is provided at second end 16 of tubular member 12, whereby one or more weights 62 are supported. Referring to FIG. 2, weight support assembly 60 includes a body 64 having a collar 66. Referring to FIG. 1, collar 66 overlies second end 16 of tubular member 12. Referring to FIG. 2, a cantilevered weight attachment screw 68 is provided having a first end 70 supported by body 64 and a remote end 72. One or more weights 62, are provided with each weight 62 having a mounting aperture 74 that slides over remote end 72 of weight attachment screw 68. A screw end cap 76 is provided which engages remote end 74 of weight attachment screw 68 to prevent weights 62 from sliding off remote end 74.

Operation:

Referring to FIG. 1, resonance vibration travels along two paths created by tubular member 12 and insert member 24. These two vibration paths are isolated by vibration dampening gel 34. Tubular member 12 vibrates at a first resonance frequency. Insert member 24 vibrates at a second resonance frequency, that differs from the first resonance frequency, due to the difference in diameter and wall thickness between tubular member 12 and insert member 24. Vibration dampening gel 34 absorbs vibration in both directions. Referring to FIG. 3, vibration is absorbed whether the vibration is traveling from archery bow 100 through mounting assembly 36 toward weight support assembly 60 or whether the vibration is traveling back from weight support assembly 60 toward mounting assembly 36 and archery bow 100.

Referring to FIG. 1, tubular insert member 24 and outer tubular member 12 vibrating at different frequencies are suspended in vibration dampening gel 34 allow vibration dampening gel to absorb the energy and dampen the vibration before the shockwave returns to the archer. Dampening is the loss of dissipation of energy over time. This dampening zone of stabilizer 10 allows for a longer dampening area than using a localized rubber insert or donut around or in the stabilizer, as is common in the industry. The length of the zone allows it to absorb a variety of vibration frequencies regardless of whether the wavelengths are long or short. Because this dampening zone has the added benefit of being around a hollow inner tube of tubular insert member 24, it does not add unnecessary weight to first end 14 of stabilizer 10, which would work against moving the mass as far forward as possible.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. An archery stabilizer, comprising:

a tubular member having a first end, a second end, an exterior surface and an interior sidewall defining an interior bore that extends between the first end and the second end, the tubular member having a first resonance frequency;

an insert member positioned in the interior bore and extending for more than one third of the length of the tubular member, the insert member having an exterior surface, the insert member having a second resonance frequency that differs from the first resonance frequency;

a vibration dampening gel positioned between the exterior surface of the insert member and the interior sidewall of the tubular member;

a mounting assembly at the first end of the tubular member, whereby the archery stabilizer is mounted to an archery bow; and a weight support assembly at the second end of the tubular member, whereby one or more weights are supported.

2. The archery stabilizer of claim 1, wherein the vibration dampening gel encapsulates the insert member and is bonded to the interior sidewall of the tubular member.

3. The archery stabilizer of claim 1, wherein the mounting assembly supports both the exterior surface and interior sidewall of the tubular member.

4. The archery stabilizer of claim 1, wherein the mounting assembly forms a mechanical connection between the insert member and the tubular member.

5. The archery stabilizer of claim 4, wherein the mounting assembly comprises:

a body having a collar which overlies the first end of the tubular member;

a cantilevered bow mounting screw having a first end supported by the body and a remote end; and an annular mounting plug having an exterior surface that engages the interior sidewall of the tubular member and an interior surface that engages the exterior surface of the insert member, the annular mounting plug being coupled with the body by mating threaded connection.

6. The archery stabilizer of claim 1, wherein the insert member is tubular having a first end and a second end, the first end being secured to the mounting assembly and the second end being closed by a closure.

7. The archery stabilizer of claim 6, wherein the closure is a bullet shaped cap.

8. The archery stabilizer of claim 1, wherein the weight support assembly comprises:

a body having a collar which overlies the second end of the tubular member;

a cantilevered weight attachment screw having a first end supported by the body and a remote end;

one or more weights, each weight having a mounting aperture that slides over the remote end of the weight attachment screw; and a screw end cap which engages the remote end of the weight attachment screw to prevent weights from sliding off the remote end.

9. An archery stabilizer, comprising:

a tubular member having a first end, a second end, an exterior surface and an interior sidewall defining an interior bore that extends between the first end and the second end, the tubular member having a first resonance frequency;

an insert member positioned in the interior bore and extending for more than one third of the length of the tubular member, the insert member having an exterior surface, the insert member having a second resonance frequency that differs from the first resonance frequency, the insert member is tubular having a first end and a second end, the second end being closed by a closure in the form of a bullet shaped cap;

a vibration dampening gel positioned between the exterior surface of the insert member and the interior sidewall of the tubular member, the vibration dampening gel encapsulating the insert member and being bonded to the interior sidewall of the tubular member;

a mounting assembly at the first end of the tubular member, whereby the archery stabilizer is mounted to an archery bow, the mounting assembly comprising:

a body having a collar which overlies the exterior surface at the first end of the tubular member;

a cantilevered bow mounting screw having a first end supported by the body and a remote end; and an annular mounting plug having an exterior surface that engages the interior sidewall of the tubular member and an interior surface that engages the exterior surface of the insert member, the annular mounting plug being coupled with the body by mating threaded connection;

a weight support assembly at the second end of the tubular member, whereby one or more weights are supported, the weight support assembly comprising:

a body having a collar which overlies the second end of the tubular member;

a cantilevered weight attachment screw having a first end supported by the body and a remote end;

one or more weights, each weight having a mounting aperture that slides over the remote end of the weight attachment screw; and a screw end cap which engages the remote end of the weight attachment screw to prevent weights from sliding off the remote end.

* * * * *